US005774420A

United States Patent [19]

Heysse et al.

[11] Patent Number: 5,774,420

[45] Date of Patent: Jun. 30, 1998

[54] METHOD AND APPARATUS FOR RETRIEVING LOGGING DATA FROM A DOWNHOLE LOGGING TOOL

[75] Inventors: Dale R. Heysse, Sugar Land; Al Jerabek, Houston, both of Tex.

[73] Assignee: Halliburton Energy Services, Inc., Houston, Tex.

[21] Appl. No.: 515,985

[22] Filed: Aug. 16, 1995

[51] Int. Cl.[6] ..... G01V 1/40

[52] U.S. Cl. ..... 367/83; 340/853.1; 340/853.9; 340/854.3

[58] Field of Search ..... 340/853.3, 853.9, 340/854.3, 855.5, 853.1, 853.2, 855.7; 367/83; 73/152.45

[56] References Cited

U.S. PATENT DOCUMENTS

| | | | |
|---|---|---|---|
| 4,766,543 | 8/1988 | Schmidt | 364/422 |
| 4,903,245 | 2/1990 | Close et al. | 340/853.3 |
| 5,034,929 | 7/1991 | Cobern et al. | 367/83 |
| 5,191,326 | 3/1993 | Montgomery | 340/855.5 |
| 5,278,550 | 1/1994 | Rhein-Knudsen et al. | 340/855.1 |
| 5,410,303 | 4/1995 | Comeau et al. | 340/853.3 |

*Primary Examiner*—Ian J. Lobo

[57] ABSTRACT

A method and apparatus for retrieving logging data from a downhole logging tool is presented. The tool includes a plurality of sensors which acquire data which is stored in memory. Upon receiving an appropriate signal from a surface control unit, the logging tool transmits the logging data from memory. This can be accomplished when drilling has paused; for example, while the well is being conditioned.

10 Claims, 1 Drawing Sheet

METHOD AND APPARATUS FOR RETRIEVING LOGGING DATA FROM A DOWNHOLE LOGGING TOOL

BACKGROUND OF THE INVENTION

The present invention relates to methods and apparatus for retrieving logging data from a logging tool while downhole. More particularly, the present invention relates to a method and apparatus for retrieving logging data from a logging tool memory while it is still downhole.

Many different types of measurement while drilling ("MWD") and logging while drilling ("LWD") systems have been developed to provide drilling engineers with more information to help them better perform their jobs. Many tools have been developed which provide information concerning the position of a drill string as well as various properties of the formation through which a well is being drilled. The more information that a drilling engineer has concerning the formations through which a well is being drilled, the easier it is for him to make important decisions while drilling the well.

MWD/LWD tools can be programmed to obtain data at various rates. This data is usually stored in memory in the tool and is retrieved after the tool is removed from the well. Some of the data can also be transmitted to the surface while the tool is still downhole by programming the tool to transmit data in real time while drilling continues.

One of the problems associated with MWD/LWD systems involves the transmission rate for transmitting the data to the surface while the tool is downhole. MWD/LWD tools are capable of acquiring data and recording it in memory much faster than it can be transmitted to the surface.

Real time logs are obtained primarily through mud pulse transmission systems and occasionally through electromagnetic or direct acoustic systems. Real time MWD/LWD logs obtained when rates of penetration exceed 100 feet per hour are typically very coarse, on the order of about one sample every four feet. At least one sample per foot is needed for good formation evaluation. Current methods cannot provide a higher resolution log until the tool is pulled to the surface and memory is retrieved.

A timely, high resolution log is very desirable when drilling through an interesting or critical part of the formation. However, many times a client is unable or reluctant to relog that part of the formation at a slower rate of penetration or trip out the tools to retrieve the data from memory. Additionally, sometimes real time telemetry is interrupted, thus producing a gap in the real time log.

Another problem that is sometimes encountered during logging while drilling occurs when the tools become stuck in the hole such that they cannot be tripped out to retrieve the high resolution data stored in memory. Occasionally this data can be retrieved by sending down a sonde on a slick or wire line which plugs into the logging tool. However, this procedure does not work very well in horizontal wells.

Accordingly, it would be an advancement in the art to provide a method and apparatus for retrieving data from a logging tool while it is still downhole. It would be a further advancement in the art if such a system was simple to operate and could be adapted to current logging systems. Such an apparatus and method are disclosed and claimed herein.

BRIEF SUMMARY OF THE INVENTION

The present invention provides a method and apparatus for retrieving data from an MWD/LWD tool while it is still downhole. In a preferred embodiment, the tool comprises a control system and a plurality of sensors for obtaining and recording formation data at periodic intervals which is stored in memory in the tool. The tool also includes a telemetry control module for transmitting data to the surface. The control system in the tool is programmable such that data can be transmitted to the surface in real time or, upon receiving a coded signal, can transmit data from memory.

The replay of the data can be accomplished when drilling is temporarily paused, such as when the hole is being conditioned, or when the tool becomes stuck in the hole. Alternatively, data can be replayed while the tool continues to penetrate the formation with the additional logging data simply being stored in memory for later recall.

DETAILED DESCRIPTION OF THE PREFERRED EMBODIMENTS

Figure 1:
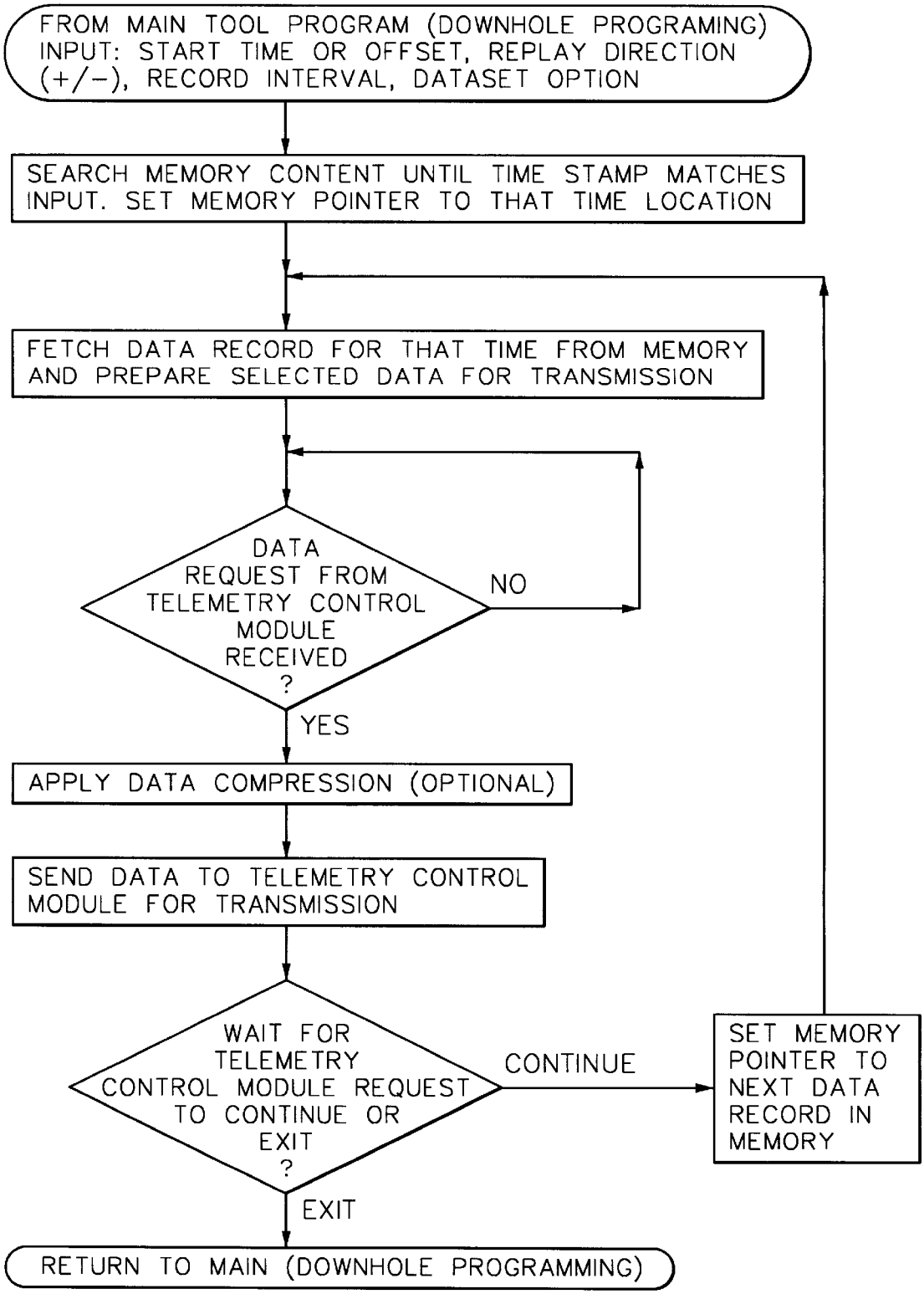
FIG. 1 is a flow chart of a replay transmission program of a preferred embodiment of the present invention.

The present invention provides a logging tool system and a method of operation which permit retrieval of logging data from a logging tool while it is still downhole. In a preferred embodiment, the system includes a surface control unit and a programmable logging tool.

The surface control unit includes a clock and a means for monitoring the depth of the logging tool which is correlated to time intervals recorded from the clock. Such systems are well known in the art and are standard equipment on downhole logging tools.

The surface control unit also includes both a transmitter and a receiver for communicating with the logging tool while it is downhole. Various systems are known in the art for affecting such communications. For example, U.S. Pat. No. 5,034,929 discloses a method and apparatus for establishing a remote communications link from a rig floor to a downhole MWD system. In one embodiment described in the '929 patent, signals are communicated by transmitting a preselected timed sequence of powering the MWD system up or down. This is accomplished by operating the mud pump in an on/off sequence which causes the MWD turbine to similarly be powered up or down. In a second embodiment disclosed in the '929 patent, signals are transmitted by modulating the mud flow in a timed sequence which results in modulations in the MWD turbine.

The logging tool in the preferred embodiment of the present invention includes a control system comprising a computer containing a clock and a main tool program. The control system also includes memory for storing logging data that is acquired by the tool. While reference is made to a single logging tool, it will be appreciated by those skilled in the art that a logging tool is often formed from a series of modules with each module having its own sensors and memory.

The logging tool also includes one or more sensors for obtaining logging data. Neutron, density, gamma and directional sensors are all well known in the art of logging. Any one or more of these sensors, as well as any other type of sensor, can be included in the present invention. These sensors operate under the control of the main tool program and are generally programmed to acquire data at set timed intervals. This data is then stored in the memory. The data is conventionally stored in a matrix system and is correlated to correspond to specific time intervals which can then be correlated with the timed intervals recorded by the surface control unit to correlate the logging data to a particular depth in the well.

In the preferred embodiment the logging tool also includes a telemetry control module which comprises a receiver and transmitter for communicating with the surface control unit. The telemetry control module transmits data to the surface control unit using any standard communications technique. The conventional method for transmitting data comprises mud pulse modulation. However, electromagnetic and direct acoustic communication systems have also been developed and can be used. Signals from the surface can be detected by various means such as pressure sensors or flow switches.

With many current MWD/LWD systems, a plurality of sensors in the logging tool acquire data which is stored in memory. A portion of this data is transmitted in real time mode to the surface control unit by a telemetry control module. The percentage of the data that can be transmitted is dependent upon both the transmission rate and the rate of acquiring data. If data is acquired at short time intervals, there is oftentimes too much data to be transmitted in real time mode. Accordingly, current MWD/LWD tools are often programmed to transmit only a portion of the data in the real time mode.

In the present invention, the control system in the logging tool is programmable and is responsive to signals transmitted from the surface control unit such that different portions of the logging data can be transmitted at different times. For example, during normal operation, the control system is programmed to transmit a portion of the logging data in real time mode. However, when the drill string reaches a location in the hole where it becomes necessary to stop further drilling and condition the well by circulating mud for a period of time, a signal can be transmitted to the logging tool to transmit additional portions of data which have been stored in memory. Alternatively, if for some reason, the tool becomes stuck in the hole, a signal can be transmitted to cause the tool to transmit some or all of the data stored in memory. The signal is transmitted from the surface control unit and is received by the telemetry control module which communicates the signal to the control system.

In a preferred embodiment, while hole conditioning is in progress, the logging tool is programmed to start transmission of memory data in a reverse time direction. A field engineer first determines the approximate time when the formation of interest was logged. This information can be retrieved from the real time transmitted log. He then programs the tool into the replay function by transmitting an appropriate signal, followed by up/down pressure sequences representing time units measured backward from current time to the point where he wants the transmission to begin. The tool will start transmission of all data stored in memory at the time instructed and continues transmission while circulation is maintained. The replay function is automatically terminated when pressure is removed and the tool returns to normal logging mode. Drilling may then resume.

In a second preferred embodiment, the data is replayed in chronological order by transmitting a proper replay signal along with pressure sequences representing time units back to the desired starting time.

Reference is next made to FIG. 1 which is a flow chart of a program of a preferred embodiment of the present invention. A signal is transmitted from the surface control unit and is received by the main tool program located in the control system of the logging tool. The signal is coded to provide various information concerning the desired replay mode. Various options can be included. For example, a specific start time can be designated or a time offset, such as 1½ hours prior to the current time, can be designated. The replay direction can also be designated; the high resolution data can be replayed in either chronological or reverse chronological order.

Depending upon the rate at which data was acquired and stored in memory, a record interval may also be transmitted to indicate that data from every time interval or only selected time intervals be replayed. Additionally, a signal may be transmitted to replay all of the data stored in memory or only a subset of the various parameters that have been measured and stored.

After the signal has been received, the main tool program searches the memory content until the time stamp matches the input parameter. A memory pointer is then set to that time location.

The data record for that time period is then retrieved from memory and prepared for transmission. Either all or only a selected portion of the data is prepared for transmission.

The main tool program then waits for a data request from the telemetry control module to indicate that it is ready to transmit the data. If the data request is received, the data is sent directly to the telemetry control module for transmission or can be subjected to data compression prior to transmission. After a data set has been transmitted, the program waits for the telemetry control module to send a signal either requesting the program to continue in the replay mode or to exit. If a continue signal is received, the memory pointer is set to the next data record in memory and the program goes back to the point where it retrieves that data record and prepares the data for transmission. If an exit signal is received, the control system returns to the main program for retrieving and storing logging data.

The invention is further understood by reference to the following example which is given for illustrative purposes only.

EXAMPLE 1

A real time resistivity log indicates a formation of interest between 9,600 and 9,720 feet. This section is logged between 16:30 to 16:50 hours at a rate of penetration ("ROP") of 360 feet per hour. The tool is transmitting real time data using one second pulse widths and provides measurement updates every 93 seconds. Because the ROP is 360 feet per hour, the distance between transmitted measurements is about 9.3 feet. The memory acquisition rate is five seconds, representing a memory resolution of about six inches. The tool is now at a deeper depth at 19:20 hours. Drilling is completed for this whole section and about five hours of mud circulation is planned to condition the hole.

The field engineer programs the tool into a reverse replay transmission function by transmitting a signal followed by two each 60-second and two each 30-second pressure-up sequences, representing 2.5 hours. This sets a memory pointer in the tool 2 ½ hours back from the current time (i.e., 16:50 hours).

The tool first transmits the date-time stamp of the first data point, followed by sequential memory parameters converted to deep phase, medium phase and gamma ray data. The date-time stamp is only transmitted once at the beginning since all following memory parameter records are at fixed, 5 second intervals. Only memory data are transmitted, in reverse order. All other logging functions are stored in memory and are not transmitted.

The approximate transmission time for three 8-bit parameters is 69 seconds, assuming a one second pulse width. At this rate, about 26 feet per hour may be transmitted at six inch resolution. The 120 feet of replay requires about 4 ½ hours.

The data received by the surface control unit is then merged with time-depth records. A log may be produced during the replay transmission. Processing of the data is identical to processing a memory dump. The log thus produced can be inserted into the real time log.

While the invention has been described with respect to the presently preferred embodiments, it will be appreciated that modifications or changes can be made without departing from its spirit or essential characteristics. For example, the logging tool of the present invention can be programmed to replay data from memory according to several different schemes. All of the data for a given time interval can be transmitted in either chronological or reverse chronological order. Alternatively, various subsets of the data stored in memory can be transmitted for given time intervals. In still further embodiments, either all or a portion of the data based on differing sampling rates can be transmitted. For example, if data is sampled every five seconds, the tool can be programmed to select the data from 20 second intervals for replay. Accordingly, all modifications or changes which come within the meaning and range of equivalency of the claims are to be embraced within their scope.

We claim:

1. A method for retrieving data from an MWD/LWD tool while downhole, comprising:

providing in a drill string in a well a programmable, downhole tool capable of acquiring data and storing it in memory;

acquiring data while drilling a well and storing said data, said data being correlated with a sequential time record in memory; and transmitting a signal to said tool from a surface system by means of a mud pulse telemetry system while downhole instructing said tool to transmit by means of said mud pulse telemetry system selected stored data from memory, where said signal includes time record data selection information.

2. A method for retrieving data as defined in claim 1 wherein said time record data selection information includes a starting time record and an ending time record corresponding to data stored in memory in said tool.

3. A method for retrieving data as defined in claim 1 wherein said data is correlated to time records in said memory and wherein data to be retrieved is determined by specifying a starting time record and a time direction.

4. A method for retrieving data as defined in claim 3 wherein said data is transmitted in reverse chronological order.

5. A method for retrieving data as defined in claim 3 wherein said data is transmitted in chronological order.

6. A method for retrieving data as defined in claim 1 wherein said signal is transmitted to said tool while said well is being conditioned by circulating mud.

7. A method for retrieving data as defined in claim 1 wherein said signal is transmitted to said tool when said tool is stuck downhole.

8. A method for retrieving data as defined in claim 1 further comprising continuing to record logging data while transmitting stored data from memory.

9. A method of retrieving data as defined in claim 1 wherein a subset of data stored in said memory is transmitted while said tool is downhole.

10. A method of retrieving data as defined in claim 1 wherein all of the data stored in memory for a specified time period is transmitted.

* * * * *